United States Patent [19]

Steiniger

[11] Patent Number: 4,579,293

[45] Date of Patent: Apr. 1, 1986

[54] APPARATUS FOR WITHDRAWING THE LEADERS OF WEBS FROM REELS OF CONVOLUTED FLEXIBLE MATERIAL

[75] Inventor: Wolfgang Steiniger, Börnsen, Fed. Rep. of Germany

[73] Assignee: Hauni-Werke Körber & Co. KG, Hamburg, Fed. Rep. of Germany

[21] Appl. No.: 672,096

[22] Filed: Nov. 15, 1984

[30] Foreign Application Priority Data

Nov. 24, 1983 [DE] Fed. Rep. of Germany ..... 3342406

[51] Int. Cl.[4] ..... G03B 1/56

[52] U.S. Cl. ..... 242/55; 226/92

[58] Field of Search ..... 242/55, 56 R, 58.3, 242/58.4, 68.3, 195; 226/91, 92, 173; 156/504–506, 515, 510, 163, 164, 248, 519–521

[56] References Cited

U.S. PATENT DOCUMENTS

| | | | |
|---|---|---|---|
| 2,265,498 | 12/1941 | Stancliff et al. | 242/56 B |
| 3,749,634 | 7/1973 | Krause | 156/505 |
| 3,773,235 | 11/1973 | Canamero | 226/173 X |
| 4,131,501 | 12/1978 | Bottcher et al. | 156/157 |
| 4,149,681 | 4/1979 | Schluter | 242/68.3 |

*Primary Examiner*—Leonard D. Christian
*Attorney, Agent, or Firm*—Peter K. Kontler

[57] ABSTRACT

The leader of a fresh reel in a cigarette making or other tobacco processing machine is engaged by the tongs on an endless chain and is advanced to a splicing device so that it can be spliced to the trailing portion of a running web which is being paid out by an expiring reel. The tongs can be opened preparatory to introduction of the leader of the fresh web between its jaws by a severing device which serves to cut the protective strip around the outermost convolution of the fresh web as well as to deflect the thus exposed leader of the web on the fresh reel into the open tongs during pivoting of the severing device from its operative to its inoperative position.

16 Claims, 5 Drawing Figures

APPARATUS FOR WITHDRAWING THE LEADERS OF WEBS FROM REELS OF CONVOLUTED FLEXIBLE MATERIAL

BACKGROUND OF THE INVENTION

The present invention relates to improvements in apparatus for manipulating bobbins or reels of convoluted flexible web- or strip-shaped material. More particularly, the invention relates to improvements in apparatus for engaging and advancing the leaders of webs which are convoluted on the cores of reels and must be withdrawn in order to be transported along a predetermined path, especially toward and through a splicing device which can connect the leader with a second web. Such apparatus can be utilized with advantage in tobacco processing machines, for example, in cigarette making, filter tipping and filter rod making machines wherein webs of cigarette paper, imitation cork or other flexible wrapping material are draped around rod-shaped fillers or are convoluted around the abutting end portions of coaxial rod-shaped articles.

It is well known to store a fresh reel of convoluted cigarette paper or other suitable wrapping material on an indexible carrier which also supports a second reel adjacent to the fresh reel. The reels are mounted on suitable spindles, and the web of the expiring reel (namely of the reel whose web is being fed into the web-consuming machine) is spliced to the leader of the fresh web before the supply of web on the expiring reel is exhausted. In many instances, fresh reels are supplied with protective bands or strips which surround the outermost convolutions of convoluted webs of wrapping material. Such protective bands must be severed in order to afford access to the leaders of the respective webs so that the leaders can be transported to the splicing station where they are about to be connected to the running webs of the expiring reels. In many instances, the means for severing the protective band on a fresh reel is designed to simultaneously sever one or more outermost convolutions of the web of wrapping material so that the actual leader of the web on the fresh reel is the free end of the second, third or further outermost convolution of the fresh reel. This reduces the likelihood that a damaged or contaminated portion of the web, which is being withdrawn from a fresh reel, will enter the web processing or consuming machine.

A modern tobacco processing machine, such as a cigarette making machine, turns out extremely large numbers of rod-shaped articles per unit of time. For example, a modern cigarette maker can turn out up to and even in excess of 8000 plain cigarettes of unit length per minute. The output of many recent types of filter rod making and filter tipping machines is also very high. Consequently, the reels of convoluted wrapping material (be it cigarette paper, tipping paper or any other kind of flexible material which is used in a tobacco processing machine) must be replaced at frequent intervals. The period of time which is available for replacement of an expired reel with a fresh reel, so that the web which is convoluted on the fresh reel enters the consuming or processing machine without any interruption upon termination of withdrawal of the web from the preceding reel, is extremely short. It has been found that the most time-consuming operation in connection with the replacement of expiring reels of wrapping material with fresh reels is the preparation of a freshly inserted reel for splicing to the web which is being paid out by the preceding or expiring reel. Such preparation involves removal of the aforementioned protective band as well as advancement of the thus exposed leader of the web on the fresh reel into the range of the splicing mechanism. Presently known apparatus which are used to prepare the webs of fresh reels for attachment to the webs of expiring reels are simply incapable of ensuring proper treatment of the leaders of fresh webs within the allotted extremely short intervals of time which are available in a modern cigarette making, filter tipping or filter rod making machine. In other words, even if such conventional apparatus are operated at the maximum speed of which they are capable, this still does not suffice to ensure predictable and accurate placing of the leader of the web on a freshly installed reel into an optimum position with reference to the splicing mechanism.

OBJECTS AND SUMMARY OF THE INVENTION

An object of the invention is to provide a novel and improved apparatus for withdrawing the leader of a web of convoluted flexible material which is stored in the form of a reel so that the withdrawal of the leader and the placing of the leader in an optimum position for attachment to another web can be completed within a fraction of the time which is required in heretofore known apparatus.

Another object of the invention is to provide an apparatus which can readily expose, engage and advance the leaders of webs on fresh reels in tobacco processing machines at the rate which is required when such machines are operated at maximum capacity.

A further object of the invention is to provide the apparatus with novel and improved means for engaging and advancing the leaders of webs on successive fresh reels.

Still another object of the invention is to provide a novel and improved method of freeing, engaging and advancing the leaders of webs on successive fresh reels of cigarette paper or the like within short intervals of time and with a higher degree of reliability, predictability and reproducibility than in accordance with heretofore known methods.

Another object of the invention is to provide the apparatus with novel and improved means for severing the protective bands which surround the outermost convolutions of webs on fresh reels of cigarette paper or the like.

An additional object of the invention is to provide the apparatus with novel and improved means for gripping the leaders of webs on successive fresh reels during transport from the carrier for a fresh reel to the mechanism which splices the leader to the running web of an expiring reel.

The invention is embodied in an apparatus for withdrawing the leader of a web of convoluted flexible material which is stored in the form of a reel or bobbin, particularly for advancing the leader of the web into the range of a web splicing device. The apparatus comprises a carrier having means (for example, a spindle) for rotatably supporting the reel, a tongs which serves to engage the leader of the web forming part of the reel on the supporting means of the carrier, and means for transporting the tongs along a predetermined path (for example, along an endless path wherein the tongs is movable in a single direction or back and forth).

The carrier preferably further comprises means (such as a second spindle) for supporting a second reel so that a fresh reel can be placed onto one of the supporting means while the other supporting means supports the expiring reel.

As mentioned above, the leader of a web which is convoluted on the core of a fresh reel is normally confined in a protective band or strip which surrounds the outermost convolution of the web. In order to adequately treat such reels, the improved apparatus preferably further comprises means for severing the protective strip (and preferably one or more outermost convolutions of the web on the fresh reel which is supported by the supporting means of the carrier) so as to provide for the tongs access to the thus exposed leader of the web.

The transporting means preferably comprises an endless conveyor, especially a chain conveyor, and drive means for the conveyor. In accordance with a presently preferred embodiment of the invention, the tongs comprises a first jaw which is or can be fixedly secured to the transporting means and a second jaw which is mounted on the transporting means for movement with reference to the first jaw. Such tongs preferably further comprises a torsion spring or other suitable means for yieldably biasing the second jaw toward engagement with the first jaw so that the leader of a web which is placed between the two jaws is reliably clamped when the biasing means is free to dissipate energy.

The apparatus preferably further comprises guide means including a portion which is pivotable about a predetermined axis. The transporting means is movably mounted on such guide means and includes a section which is pivotable with the aforementioned portion of the guide means with reference to the carrier and with reference to the reel on the supporting means of the carrier. The guide means preferably defines a channel and the endless conveyor of the transporting means is or can be provided with follower means which extend or extends into and are or is slidable in the channel. The aforementioned severing means for the protective strip is preferably movably mounted on the guide means, and such apparatus preferably further comprises means for moving the severing means relative to the guide means between an operative position and an inoperative position. The severing means preferably includes means for opening the tongs in response to movement to the operative position. In accordance with a presently preferred embodiment of the invention, the severing means is pivotable with reference to the guide means in order to move between its operative and inoperative positions. The aforementioned opening means of the severing means can include an entraining element or other suitable means for moving the one (movable) jaw away from the other jaw against the opposition of the biasing means.

The severing means preferably further comprises means for automatically moving the leader of the web between the jaws of the tongs in response to movement of the severing means from the operative position while the one jaw is held in the open position. For example, the means for moving the leader of the web between the jaws of the tongs can include a holder which carries the knife of the severing means. Such severing means preferably comprises means for shifting the knife and its holder in substantial parallelism with the axis of the reel on the supporting means between an extended and a retracted position and for maintaining the knife and its holder in the extended position, at least during the initial stage of movement of the severing means to its inoperative position. The knife holder can be said to constitute a component part of such shifting means and, as mentioned above, can serve as a means for moving the leader of the web between the jaws of the tongs.

The transporting means is preferably disposed at a level below the supporting means, and the apparatus preferably further comprises means for indexing the carrier about a predetermined axis with reference to the transporting means so as to move a fresh reel into the range of the tongs and to move a freshly expired reel away from the path along which the tongs is to move the leader of the web on the fresh reel. This enables an operator or an automatic applying mechanism to remove the expired reel and to replace such expired reel with a fresh reel.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
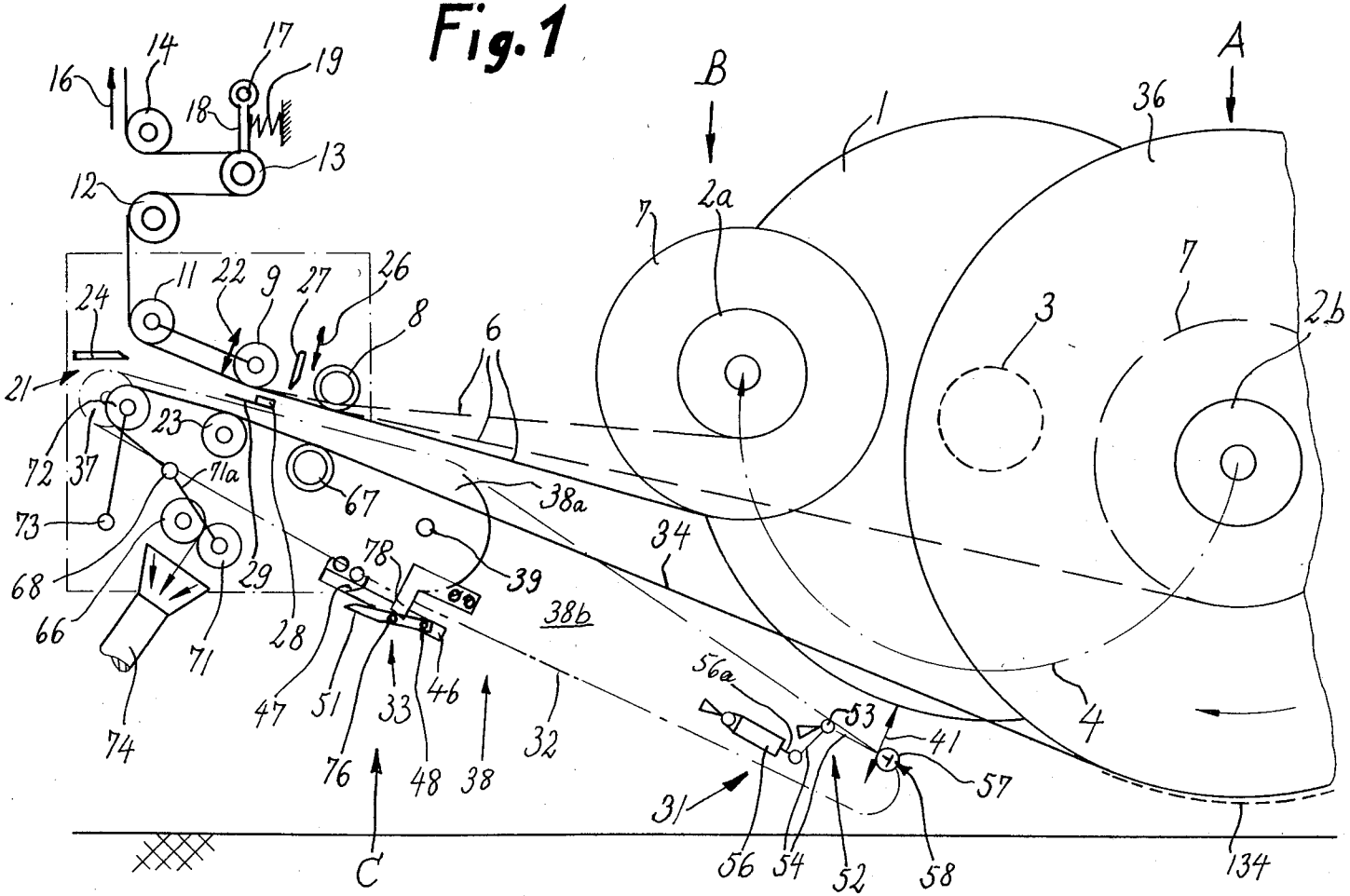
FIG. 1 is a schematic elevational view of an apparatus which embodies the invention and is installed in a cigarette rod making machine to advance the leaders of webs on fresh reels into the range of a web splicing device.
Figure 2:
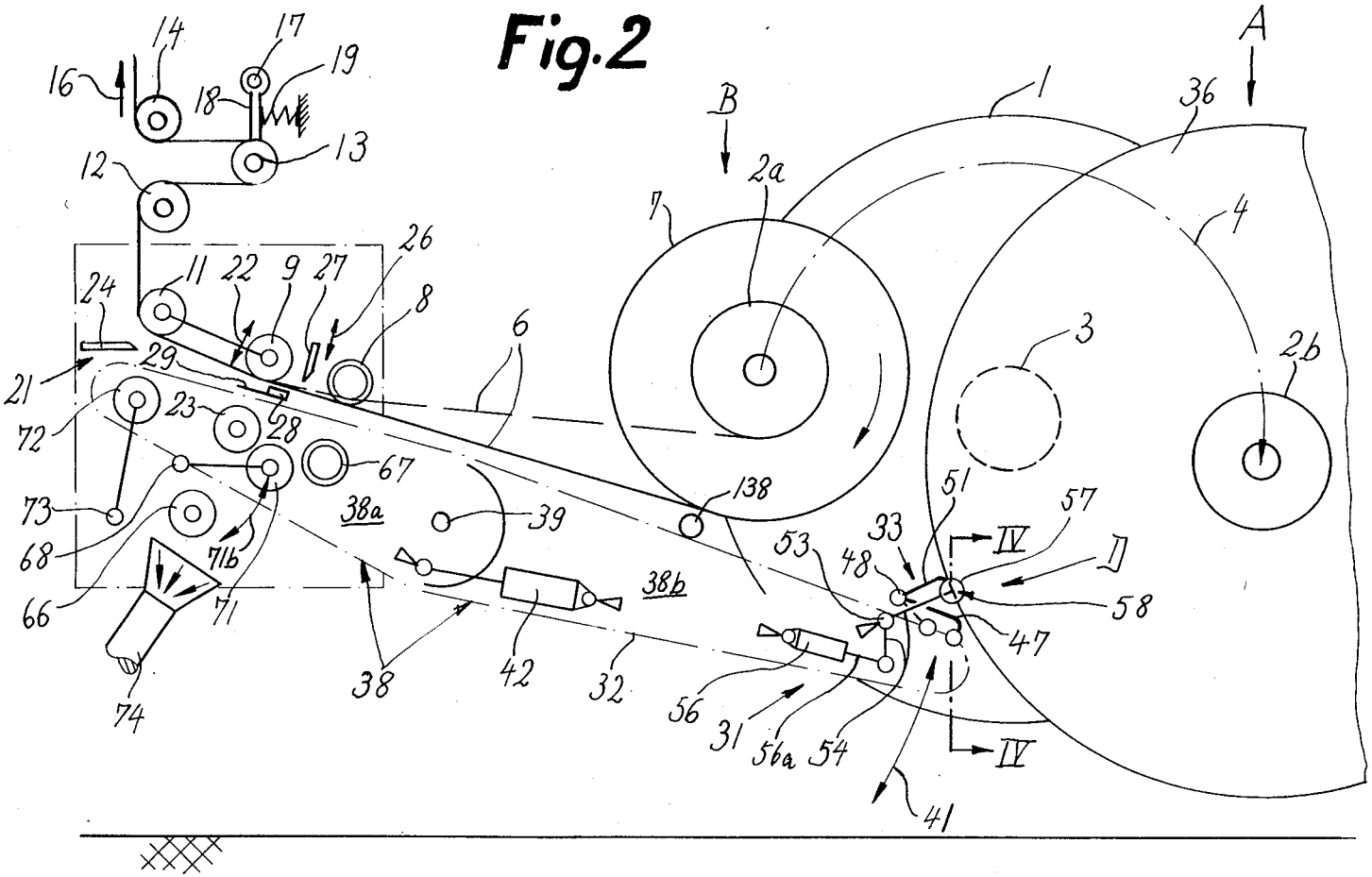
FIG. 2 is a view which illustrates the structure of FIG. 1 but with the tongs moved adjacent to the protective strip of a fresh reel.

The apparatus which is shown in FIGS. 1 and 2 comprises a carrier 1 which is mounted on a horizontal shaft 3 forming part of means for indexing the carrier through angles of substantially 180° in the direction of arrow 4. The carrier 1 supports two identical reel supporting means 2*a* and 2*b* each of which can constitute a horizontal spindle having means for releasably holding the core of the respective reel. The supporting means 2*a* and 2*b* are mirror symmetrical to each other with reference to a plane which includes the axis of the indexing shaft 3. The manner in which the supporting means 2*a* and 2*b* can releasably engage and hold the cores of reels thereon is disclosed, for example, in commonly owned U.S. Pat. No. 4,149,681 granted Apr. 17, 1979 to Schlüter.

The supporting means 2*a* carries an expiring bobbin or reel 7 which is indexed from the broken-line position to the solid-line position of FIG. 1 when the diameter of the outermost convolution of the web 6 which is convoluted on its core is reduced to a predetermined value.

This renders it possible to mount on the other supporting means 2b a fresh bobbin or reel 36 which contains a supply of convoluted web 34 and, initially, a protective band or strip 134 which surrounds the outermost convolution and must be removed in order to afford access to the leader of the web 34.

The web 6 which is being paid out by the expiring reel 7 moves tangentially along a stationary guide member 8, thereupon along the underside of a mobile splicing roller 9, around additional rollers 11, 12, 13, 14 and thereafter advances in the direction of arrow 16 toward the wrapping station of the cigarette rod making machine, for example, a machine of the type known as PROTOS which is manufactured and sold by the assignee of the present application. The roller 13 acts as a dancer roller and is mounted at one end of a lever 18 which is pivotable about a pin 17 and is biased by a coil spring 19 so as to form between the rollers 12, 14 a loop and to thereby maintain the web 6 under a certain amount of tension. The purpose of the lever 18 which carries the dancer roller 13 is to adjust a potentiometer (not shown) which controls the operation of brakes associated with the supporting means 2a and 2b on the carrier 1. The manner in which the lever 18 can control or adjust a potentiometer for the just described purpose is disclosed in commonly owned U.S. Pat. No. 4,131,501 granted Dec. 26, 1978 to Böttcher et al. A switchover device (also disclosed in the just mentioned patent to Böttcher et al.) is provided to ensure that the potentiometer is invariably connected with the brake for that supporting means (2a or 2b) which carries the expiring reel. The switchover device is actuated by or in response to actuation of a splicing device 21 which is provided to connect the leader of the web 34 on the fresh reel 36 with the running web 6 which is being paid out by the expiring reel 7. As mentioned above, the roller 9 which guides the web 6 for movement along a predetermined path leading into the cigarette rod making machine forms part of the splicing device 21 and, for such purpose, is movable in directions indicated by a double-headed arrow 22. The splicing device 21 further comprises a stationary roller 23 which is located opposite the roller 9, a stationary knife 24, a second knife 27 which is shiftable in directions indicated by a double-headed arrow 26, and a support 28 for an adhesive-coated strip 29. Both sides of the strip 29 are coated with adhesive so that, when the roller 9 is shifted toward the roller 23, one side of the strip 29 adheres to the running web 6 and the other side of the strip 29 adheres to the web 34 in order to connect such webs to each other. The details of a splicing device which is analogous to the splicing device 21 of FIGS. 1 and 2 are disclosed in commonly owned U.S. Pat. No. 3,749,634 granted July 31, 1973 to Krause.

Figure 3:
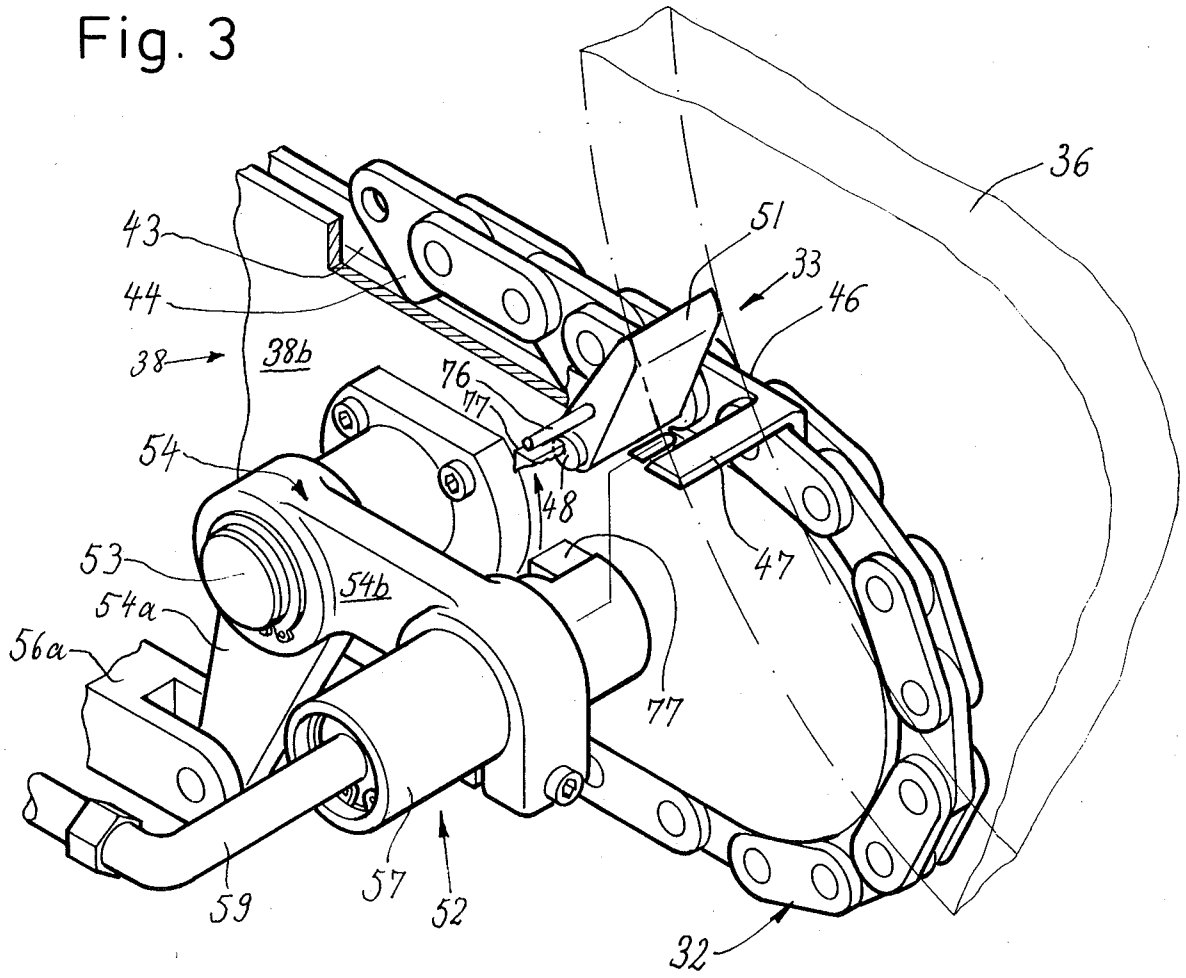
FIG. 3 is an enlarged perspective view of a portion of the transporting means, of the tongs on the transporting means, of the severing means for the protective band, and of a portion of the guide means for the transporting means.

The carrier 1 is adjacent to a transporting unit 31 which includes an endless chain 32 supporting a tongs 33 for engaging and withdrawing the leader of the web 34 which forms the convolutions on the core of the fresh reel 36. The means for driving the chain 32 comprises a sprocket wheel 37 which is mounted on a stationary portion 38a of a guide means 38 further including a second portion 38b which is pivotable relative to the stationary portion 38a about the axis of a horizontal pivot member 39. The means for pivoting the portion 38b of the guide means 38 between the positions of FIGS. 1 and 2 includes a fluid-operated motor 42, for example, a hydraulically or pneumatically operated cylinder and piston unit which is shown in FIG. 2. The directions in which the portion 38b of the guide means 38 is pivotable about the axis of the shaft 39 are indicated by a double-headed arrow 41. As can be seen in FIG. 3, the guide means 38 is formed with a circumferentially extending guide groove 43 for spaced-apart slidable followers 44 forming part of or connected to the links of the endless chain 32.

Figure 4:
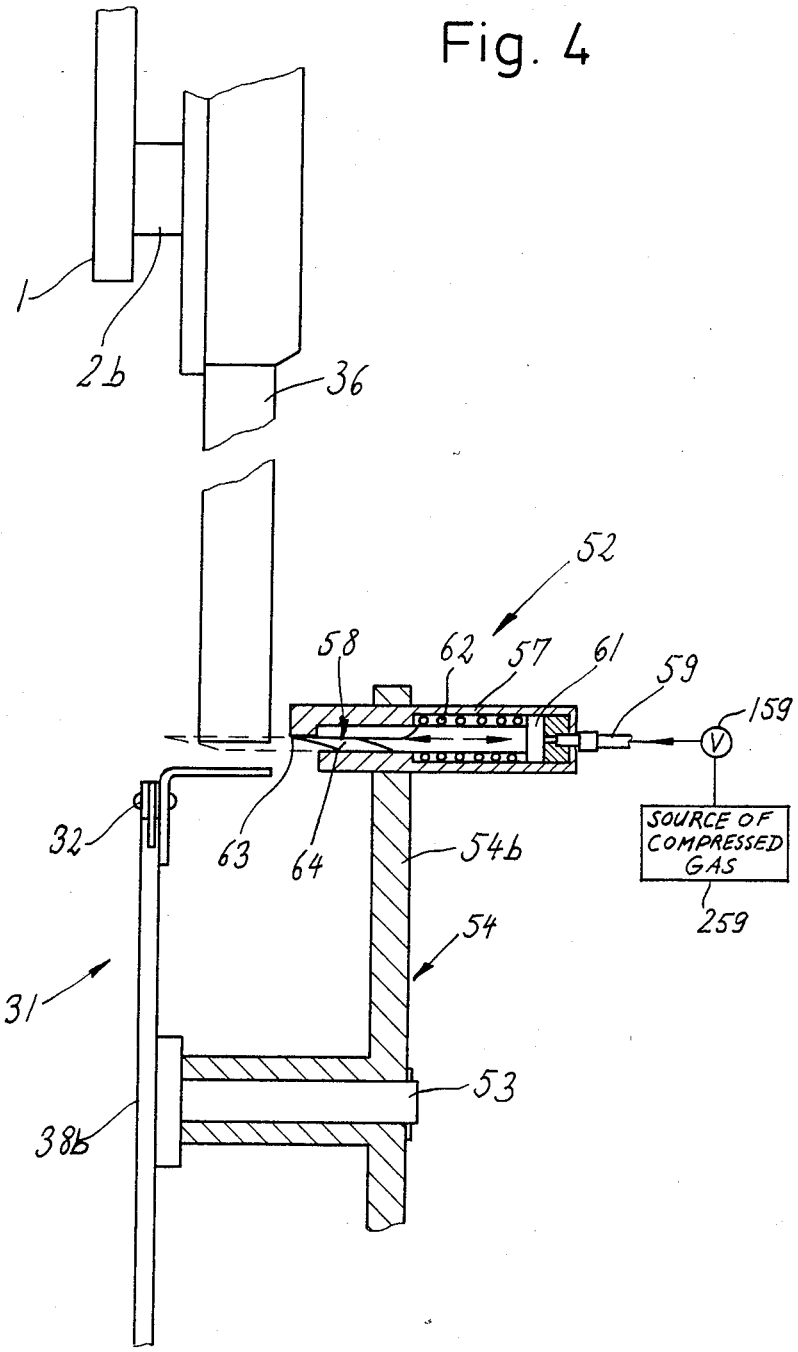
FIG. 4 is an enlarged sectional view as seen in the direction of arrows from the line IV—IV in FIG. 2.
Figure 5:
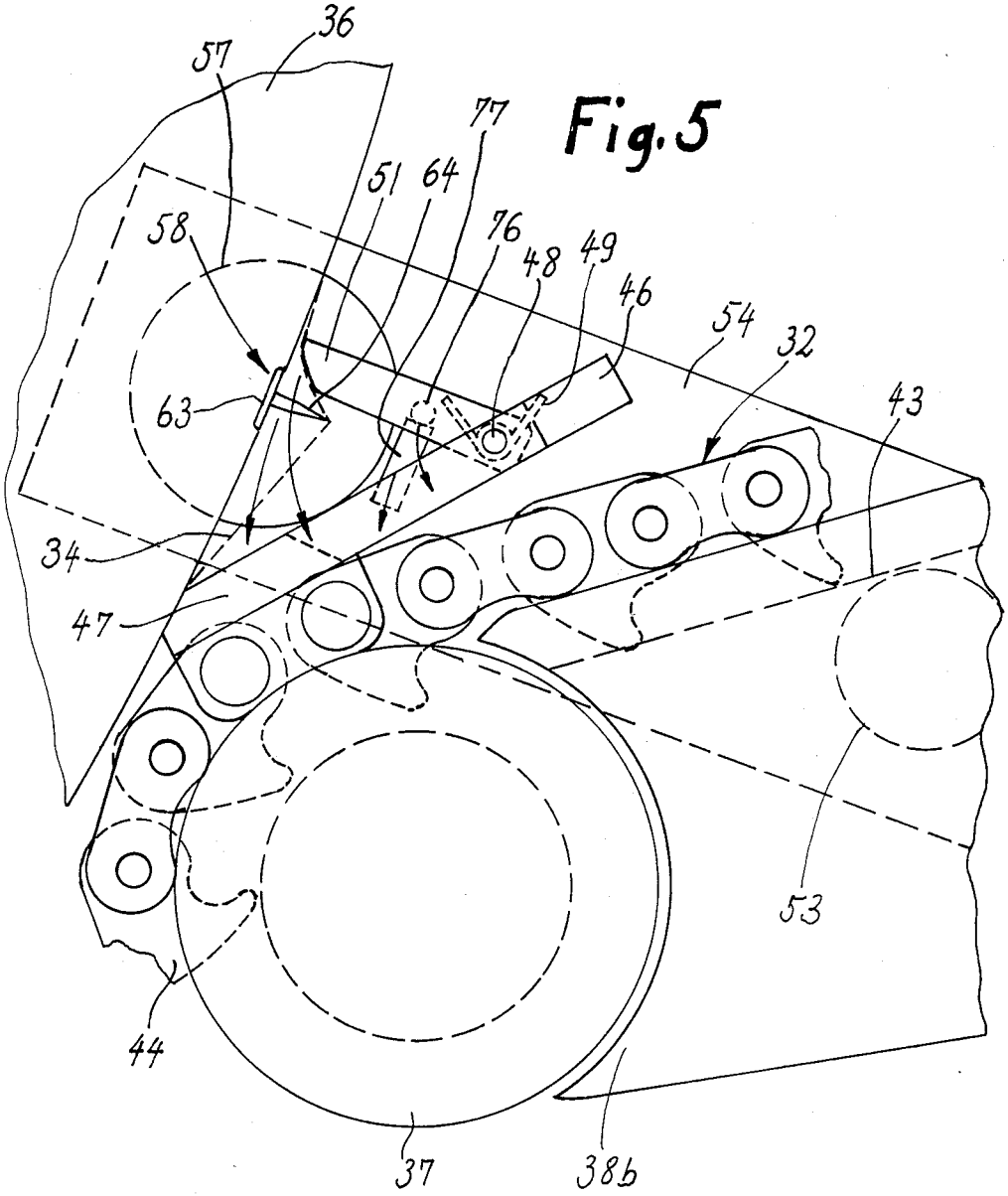
FIG. 5 is an enlarged view of the severing station as seen from the rear side of FIG. 1 or FIG. 2.

FIGS. 3, 4 and 5 show that the chain 32 includes a fixedly mounted holder 46 having a lateral extension 47 which constitutes the stationary jaw of the tongs 33. The holder 46 further supports a pivot member 48 which is parallel to the pivot member 39 and to the supporting means 2a, 2b and supports a movable second jaw 51. A torsion spring 49 is provided to bias the jaw 51 in a clockwise direction, as viewed in FIG. 3 (i.e., in a counterclockwise direction, as viewed in FIG. 5), so that the mobile jaw 51 normally tends to engage the adjacent portion of the fixed jaw 47. The coil or coils of the torsion spring 49 surround the pivot member 48 for the jaw 51.

The pivotable portion 38b of the guide means 38 further supports a severing device 52 which serves to cut across the protective band 134 for the fresh reel 36 and preferably also across the adjacent outermost convolutions of the web 34. The portion 38b of the guide means 38 carries a shaft 53 which is parallel with the pivot member 48 and supports a bell crank lever 54 having a first arm 54a connected to a motion transmitting member 56a which constitutes the piston rod of a fluid-operated motor 56 mounted on the pivotable portion 38b and serving to pivot the bell crank lever 54 to and from the open position which is shown in FIG. 3.

The other arm 54b of the bell crank lever 54 of the shaft 53 supports a cylinder 57 whose axis is parallel to the axis of the shaft 53 and to the axes of the supporting means 2a and 2b. The cylinder 57 contains a piston 61 which is biased to the retracted position of FIG. 4 by a helical spring 62 reacting against an internal shoulder of the cylinder 57. A pneumatic conduit 59 is provided to admit compressed air or another gaseous fluid to the right-hand side of the piston 61, as viewed in FIG. 4 so as to move the piston 61 to an extended position against the opposition of the spring 62. The piston 61 carries a holder 63 for a transversely extending knife 64. The extended position of the holder 63, which is preferably a thin leaf spring, is shown in FIG. 4 by broken lines. In such extended position, the holder 63 extends across the full thickness of the reel 36, as considered in the axial direction of the respective supporting means 2b. The knife 64 forms part of constitutes a slitting device 58 which is designed to slit the protective band 134 open all the way from one to the other axial end of the reel 36 and to preferably sever one or more outermost convolutions of the web 34. When the valve 159 in the conduit 59 is allowed to permit escape of compressed air from the cylinder 57 into the surrounding atmosphere, the spring 62 is free to expand and to return the holder 63 and its knife 64 to the retracted positions which are shown in FIG. 4 by solid lines. The source of compressed air is shown at 259.

The means for guiding the web 34 which is to be paid out by the fresh reel 36 along a predetermined path includes a plurality of additional components which are shown in the left-hand portions of FIGS. 1 and 2. Such components include the aforementioned stationary roller 23 of the splicing device 21, a cylindrical guide member 67 which is mounted on the stationary portion 38a of the guide means 38, a driven advancing roller 66, a second advancing roller 71 which is mounted on an arm 71*a* and is movable in directions indicated by the double-headed arrow 71*b* about the axis of a shaft 68, and a deflecting or looping roller 72 which is pivotable about the axis of a stationary shaft 73 and serves to loop a portion of the web 34 so as to facilitate its severing by the knife 24 of the splicing device 21.

The apparatus further comprises a suction box 74 which is adjacent to the driven advancing roller 66 and can attract the severed protective band 134 as well as the severed portions or lengths of the web 34.

In accordance with an additional feature of the invention, the severing device 52 comprises means for pivoting the jaw 51 of the tongs 33 to open position in response to pivoting of the bell crank lever 54 in a counterclockwise direction, as viewed in FIG. 3. The means for moving the jaw 51 to such open position includes a projection or platform 77 on the cylinder 57 and a stud 76 which is provided on the jaw 51 and is located in the path of movement of the platform 77 when the lever 54 is caused to turn from the inoperative position of FIG. 3 to the operative position of FIG. 5. The movable portion 38*a* of the guide means 38 comprises an entraining device 78 (see FIG. 1) which can move the jaw 51 to the open position at a time when the tongs 33 is remote from the fresh reel 36.

The mode of operation of the apparatus which is shown in FIGS. 1 to 5 is as follows:

It is assumed that the carrier 1 for the supporting means 2*a* and 2*b* is located in the position of FIG. 1. The supporting means 2*a* is held in the position A until the diameter of the reel 7 thereon is reduced to a predetermined value whereupon the carrier 1 is indexed by the shaft 3 in the direction of arrow 4 to move the reel 7 from the position A to the position B. This moves a totally spent reel (not shown) on the supporting means 2*b* from the position B to the position A. Such spent reel is thereupon removed and is replaced with the fresh reel 36 which carries the protective band 134 a portion of which is indicated in FIG. 1 by a broken line. During removal of the spent reel and mounting of the fresh reel 36 on the supporting means 2*b*, the web 6 which is being paid out by the expiring wheel 7 continues to advance in the direction of the arrow 16 and into the cigarette rod making machine.

When the attachment of the fresh reel 36 to the supporting means 2*b* is completed, the motor which drives the sprocket wheel 37 for the endless chain 32 of the transporting unit 31 is started to move the tongs 33 from the position C of FIG. 1 to the position D of FIG. 2. During such movement of the tongs 33 from the position C to the position D, the pivotable portion 38*b* of the guide means 38 remains in the position of FIG. 1 in which it is remote from the carrier 1 and from the fresh reel 36 on the supporting means 2*b*. In the next step, the motor 42 is actuated to pivot the portion 38*b* of the guide means 38 to the position of FIG. 2, i.e., the tongs 33 is moved closer to the protective strip or band 134 on the fresh reel 36. A stop 138 is provided to arrest the portion 38*b* of the guide means 38 in the angular position of FIG. 2. The brake which normally holds the carrier 1 against rotation about the axis of the indexing shaft 3 is thereupon disengaged so that the weight of the relatively heavy fresh bobbin 36 causes the carrier 1 to continue to turn in the direction of arrow 4 whereby the protective strip 134 comes into abutment with the stationary jaw 47 of the tongs 33.

As can be seen in FIGS. 3 and 5, the motor 56 is thereupon operated so as to pivot the bell crank lever 54 and the severing device 52 from the inoperative position of FIG. 3 to the operative position of FIG. 5. Such pivoting takes place about the axis of the shaft 53 which is affixed to the movable portion 38*b* of the guide means 38. As the severing device 52 approaches its operative position, the platform 77 of the cylinder 57 engages the stud 76 of the jaw 51 and pivots the latter against the opposition of the torsion spring 49 in a clockwise direction, as viewed in FIG. 5, so that the jaw 51 is moved upwardly and away from the fixed jaw 47 of the tongs 33. The tip of the pivotable jaw 51 comes into abutment with the outer side of the protective strip 134 of the fresh reel 36.

In the next step, the valve 159 in the conduit 59 for the cylinder 57 is opened so that the piston 61 is caused to move against the opposition of the helical spring 62 and moves the holder 63 as well as the knife 64 to the extended positions shown in FIG. 4 by broken lines. The movement of the holder 63 takes place in parallelism with the axis of the reel 36, i.e., in parallelism with the axis of the supporting means 2*b*. The relatively thin holder 63 thereby penetrates between the outermost layers of the web 34 on the fresh reel 36 and the knife 64 severs the protective strip 134 as well as the adjacent outermost convolution or convolutions of the web 34. The valve 159 thereupon remains open for a certain interval of time so that the holder 63 continues to dwell in the extended position. Consequently, and as a result of pivoting of the severing device 52 back to the inoperative position of FIG. 3 under the action of the fluid-operated motor 56, the holder 63 constitutes a means for moving the strip 134 and the adjacent portions of the web 34 into the space between the jaws 47 and 51 of the tongs 33 during the initial stage of movement of the severing device 52 back to its inoperative position. The leader of the web 34 and the adjacent portions of the strip 134 are pressed against the fixed jaw 47 of the tongs 33 until the platform 77 allows the stud 76 to descend under the action of the torsion spring 49 so that the pivotable jaw 51 moves toward the fixed jaw 47 and the two jaws clamp the leader of the web 34 therebetween. In the next step, the valve 159 allows compressed air to escape from the corresponding chamber of the cylinder 57 so that the spring 62 is free to expand and to return the holder 63 and the knife 64 to the retracted positions which are shown in FIG. 4 by solid lines.

In the next step, the sprocket wheel 37 is driven again to advance the endless chain 32 in a counterclockwise direction, as viewed in FIGS. 1 and 2, so that the tongs 33 is returned from the position D of FIG. 2 to the position C of FIG. 1. This advances the leader of the web 34 (such leader is clamped between the jaws 47 and 51) along the aforementioned path and into the space between the advancing rollers 66 and 71. The portion 38*b* of the guide means 38 is pivoted from the raised position of FIG. 2 to the lowered position of FIG. 1 as soon as the tongs 33 reassumes the position C of FIG. 1. This causes the entraining means 78 on the portion 38*b* of the guide means 38 to open the tongs 33 by moving the jaw 51 away from the jaw 47. Such movement of the jaw 51 is effected because the entraining means 78 engages the stud 76 of the pivotable jaw 51 and lifts the latter off the stationary jaw 47 so that the leader of the web 34 is released.

In the next step, the second advancing roller 71 is moved toward the driven advancing roller 66 and is set in rotary motion so that the rollers 66 and 71 cooperate to draw the web 34 off the fresh reel 36 by rotating the reel 36 in a counterclockwise direction, as viewed in FIG. 1. The box 74 is connected to the intake of a suction generating device (not shown) so that it attracts the flexible material which is adjacent to its inlet below the nip of the advancing rollers 66 and 71. Either or both of these advancing rollers 66 can be driven as soon as the roller 71 is pivoted toward the roller 66 so as to pinch the leader of the web 34 and the severed protective strip 134 as well as one or more severed outermost convolutions of the web 34 therebetween. For example, the roller 66 can be driven for a period of time and at a speed which is required to rotate the fresh reel 36 through one and a half revolutions which ensures that a clean portion of the web 34 is located at the splicing station and that the speed of the web 34 equals or approximates the speed of the web 6.

When the supply of web 6 on the expiring reel 7 on the supporting means 2*a* of the carrier 1 is nearly or completely exhausted, the speed of the reel 7 reaches a value at which the splicing device 21 is set in operation to attach the trailing portion of the web 6 to the leader of the web 34. At such time, the advancing rollers 66 and 71 have completed the acceleration of the web 34 to a speed which at least approximates but preferably equals the speed of the web 6. The roller 9 of the splicing device 21 is then moved downwardly, as viewed in FIG. 1, so that it moves the web 6 against the adjacent adhesive-coated side of the connecting strip 29 and moves the other adhesive-coated side of the strip 29 against the moving web 34. This entails that the webs 6 and 34 are spliced to each other. The knife 27 is then moved toward the web 6 to sever the latter behind the freshly formed splice (i.e., behind the strip 29 which connects the webs 6 and 34 to each other). That portion of the fresh web 34 which is located ahead of the splice is looped at such time by the roller 72 so that it is moved against and is severed by the stationary knife 24 whereupon the web 34 advances along the rollers 11, 12, 13 and 14 in the direction of arrow 16 and into the cigarette rod making machine to be converted into the wrapper of a cigarette rod.

An important advantage of the improved apparatus is its simplicity. Such simplicity is enhanced by the provision of the platform 77 or other suitable entraining means on the severing device 52 so that the latter can open the tongs 33 by pivoting the jaw 51 away from the jaw 47 when the severing device 52 is moved from the inoperative to the operative position.

The simplicity of the apparatus is enhanced still further due to the fact that the holder 63 for the knife 64 remains in the extended position during pivoting of the severing device 52 back to the inoperative position of FIG. 3. This enables the holder 63 to move the leader of the web 34 into the space between the jaws 47 and 51 of the open tongs 33 in a manner as best shown in FIG. 5 so that the leader is reliably engaged by the tongs 33 as soon as the jaw 51 is allowed to follow the bias of the torsion spring 49, i.e. as soon as the severing device 52 has left its operative position sufficiently to enable the platform 77 to become disengaged from the stud 76 or to enable the stud 76 and the jaw 51 to follow the bias of the torsion spring 49 in order to move the jaw 51 into renewed engagement with the stationary jaw 47 and more particularly with the flexible material between the two jaws.

An important advantage of the tongs 33 is that its jaws 47 and 51 can positively and strongly engage the leader of the web 34 so that the latter can be rapidly accelerated and its leader moved to the position C of FIG. 1 where the tongs 33 is opened automatically by the entraining means 78 of the pivotable portion 38*b* of the guide means 38. The manner in which the movements of various parts in the improved apparatus are synchronized with one another forms no part of the present invention. The synchronizing means can include suitable monitoring devices in the form of photoelectric cells, mechanical sensors and/or others which ensure that the movements take place in an optimum sequence.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for withdrawing the leader of a web of convoluted flexible material which is stored in the form of a reel, particularly for advancing the leader of such web into the range of a web splicing device, comprising a carrier having means for rotatably supporting the reel; tongs arranged to engage the leader of the web forming part of the reel on the supporting means of said carrier; means for transporting the tongs along a predetermined path, said tongs comprising a first jaw mounted on said transporting means and a second jaw mounted on said transporting means for movement with reference to said first jaw; and means for moving the leader of the web between said jaws so that the tongs can entrain the leader along said path.

2. The apparatus of claim 1, wherein said carrier further comprises means for supporting a second reel.

3. The apparatus of claim 1 for withdrawing the leader of a web which is normally confined in a protective strip surrounding the outermost convolution of the web on the reel which is mounted on the supporting means of said carrier, further comprising means for severing the protective strip so as to provide for said tongs access to the thus exposed leader of the web, said severing means including said moving means.

4. The apparatus of claim 1, wherein said transporting means comprises an endless conveyor and drive means for said conveyor.

5. The apparatus of claim 4, wherein said conveyor includes a chain.

6. The apparatus of claim 1, wherein said tongs further comprises means for yieldably biasing said second jaw toward engagement with said first jaw.

7. The apparatus of claim 1, further comprising guide means including a portion pivotable about a predetermined axis, said transporting means being movably mounted on said guide means and including a section pivotable with said portion with reference to said carrier and the reel on the supporting means of said carrier.

8. The apparatus of claim 1, further comprising guide means for said transporting means, said guide means defining a channel and said transporting means including an endless conveyor having follower means extending into and slidable in said channel.

9. The apparatus of claim 1 for withdrawing the leader of a web which is normally confined in a protective strip surrounding the outermost convolution of the web on the reel which is mounted on the supporting means of said carrier, further comprising guide means for movably supporting said transporting means, means for severing the protective strip so as to provide for said tongs access to the thus exposed leader of the web, said severing means being movably mounted on said guide means, and means for advancing said severing means with reference to said guide means between an operative and an inoperative position, said severing means including said moving means and means for opening said tongs in response to movement to said operative position.

10. The apparatus of claim 9, wherein said severing means is pivotable with reference to said guide means between said operative and inoperative positions thereof.

11. The apparatus of claim 9, wherein said tongs further comprises means for biasing said second jaw toward engagement with said first jaw, said opening means including means for moving said second jaw away from said first jaw against the opposition of said biasing means.

12. The apparatus of claim 9, wherein said second jaw is movable with reference to said first jaw between open and closed positions, said moving means being arranged to move the leader of the web between said jaws in response to movement of said severing means from said operative position in the open position of said second jaw.

13. The apparatus of claim 12, wherein said severing means includes a knife and a holder for said knife, said holder constituting the means for moving the leader of the web between said jaws.

14. The apparatus of claim 12, wherein said severing means comprises a knife and means for shifting said knife in substantial parallelism with the axis of the reel on the supporting means between an extended and a retracted position and for maintaining said knife in said extended position at least during the initial stage of movement of said severing means to said inoperative position, said shifting means including said means for moving the leader of the web between said jaws.

15. The apparatus of claim 1, wherein said transporting means is disposed at a level below said supporting means.

16. The apparatus of claim 1, further comprising means for indexing said carrier about a predetermined axis with reference to said transporting means.

* * * * *